US005271891A

United States Patent [19]

Gay et al.

[11] Patent Number: 5,271,891

[45] Date of Patent: Dec. 21, 1993

[54] METHOD OF SINTERING USING POLYPHENYLENE OXIDE COATED POWDERED METAL

[75] Inventors: David E. Gay, Noblesville; Robert W. Ward, Anderson, both of Ind.

[73] Assignee: General Motors Corporation, Detroit, Mich.

[21] Appl. No.: 915,587

[22] Filed: Jul. 20, 1992

[51] Int. Cl.[5] ..... B22F 1/00

[52] U.S. Cl. ..... 419/36; 419/35; 419/38

[58] Field of Search ..... 252/62.54; 148/301, 148/104; 264/126; 419/36, 35, 38

[56] References Cited

U.S. PATENT DOCUMENTS

| | | | |
|---|---|---|---|
| 1,783,561 | 12/1930 | Eisenmann et al. | 252/62.54 |
| 1,789,477 | 1/1931 | Roseby | 252/62.54 |
| 1,982,689 | 12/1934 | Polydoroff | 175/21 |
| 2,162,273 | 6/1939 | Schulze | 175/21 |
| 2,386,544 | 4/1943 | Crowley | 419/36 |
| 2,709,651 | 5/1955 | Gurnick et al. | 419/36 |
| 3,451,934 | 6/1969 | Hubbard | 252/62.54 |
| 3,935,340 | 1/1976 | Yamaguchi et al. | 427/216 |
| 4,462,919 | 7/1984 | Saito et al. | 252/62.54 |
| 4,502,982 | 3/1985 | Horie et al. | 252/513 |
| 4,543,208 | 9/1985 | Horie et al. | 252/62.54 |
| 4,601,753 | 7/1986 | Soileau | 75/251 |
| 4,601,765 | 7/1986 | Soileau et al. | 148/104 |
| 4,696,725 | 9/1987 | Ochiai | 252/62.54 |
| 4,832,891 | 5/1989 | Kass | 264/101 |
| 4,869,964 | 9/1989 | Mazany | 428/418 |
| 4,876,305 | 10/1989 | Mazany | 524/401 |
| 4,988,755 | 1/1991 | Dickens, Jr. et al. | 524/401 |
| 5,063,011 | 11/1991 | Rutz et al. | 264/126 |
| 5,162,440 | 1/1990 | Akkapeddi et al. | 525/149 |
| 5,194,476 | 3/1993 | Casarini et al. | 524/360 |
| 5,198,137 | 3/1993 | Rutz et al. | 252/62.54 |
| 5,211,896 | 5/1993 | Ward et al. | 264/126 |

OTHER PUBLICATIONS

Sands et al., *Powder Metallurgy*, 1966, pp. 204–217, London: William Clowes and Sons, Ltd.

*Primary Examiner*—Donald P. Walsh
*Assistant Examiner*—Anthony R. Chi
*Attorney, Agent, or Firm*—George A. Grove; Lawrence B. Plant; Domenica N. S. Hartman

[57] ABSTRACT

A polymeric coating material is provided for coating powdered materials and, more particularly, for coating powdered metals formed into parts and sintered, such as to form magnetic cores. The thermoplastic material is polyphenylene oxide which, when properly applied to metal particles to form a magnetic core, is characterized by being sufficiently volatile so as to prevent the formation of contaminants or voids within the sintered article which would be detrimental to the physical properties of the sintered article. Moreover, polyphenylene oxide provides sufficient lubrication and adhesion between adjacent metal particles during an initial compaction process so as to sustain the desired shape of the molded article and maximize metal particle density without the use of additional lubricants, thereby preventing the formation of additional contaminants and/or voids within the resultant sintered article from these lubricants.

15 Claims, No Drawings

METHOD OF SINTERING USING POLYPHENYLENE OXIDE COATED POWDERED METAL

This patent application is related to co-pending U.S. patent application Ser. No. to Ward et al, assigned to the assignee of this invention and filed on or about the same day as this invention.

The present invention generally relates to coating metal particles with a polymer for purposes of forming solid metallic articles, such as by sintering. More particularly, this invention relates to an improved coating system, wherein the process of sintering articles from the coated metal particles is facilitated by the use of polyphenylene oxide as the polymer coating.

BACKGROUND OF THE INVENTION

The use of powdered metals, and particularly iron and its alloys, is known for forming permanent magnets, such as soft magnetic cores for transformers, inductors, AC and DC motors, generators, and relays. An advantage to using powdered metals is that forming operations, such as compression or injection molding and/or sintering techniques, can be used to form intricate molded part configurations, such as magnetic cores, without the need to perform additional machining and piercing operations. As a result, the formed part is often substantially ready for securement within its working environment as formed by the molding process.

Before sintering, the powdered metals are molded by techniques such as compression or injection molding. Molded magnetic cores for AC applications must have low core losses; therefore, the individual metal particles must be electrically insulated from each other. Numerous types of insulating materials, which also act as the binder required for molding, have been suggested by the prior art, including inorganic materials such as iron phosphate and alkali metal silicate. A list of the different organic polymeric materials suggested by the prior art is extensive and includes amber, phenol-aldehyde condensation products, varnishes formed from China-wood oil and phenol resin, resinous condensation products of urea or thiourea and their derivatives with formaldehyde, polymerized ethylene, butadiene, acrylic acid esters and their derivatives, copolymers of two or more of the above polymers as well as fluorine-type polymers, radical polymerizable monomers such as styrene, vinyl acetate, vinyl chloride, acrylonitrile, divinyl benzene, N-methylol acrylamide, silicones, polyimides, fluorocarbons and acrylics. In addition, it is known to coat a powdered metal with an inorganic undercoating and then provide an organic topcoat.

While the above materials generally provide adequate insulation and adhesion between metal particles upon molding, additional properties are often desirable of a coating material. One such property is the ability to provide lubrication during the molding operation so as to enhance the flowability and compressibility of the particles, and therefore enable the particles to attain maximum density and strength. This is true not only for molded articles, where as-molded strength and density are obviously required, but also for sintered applications, where the molded articles are further consolidated to attain even greater strength and density.

It is often preferable to sinter the magnetic core after the molding process, such as where the solid magnetic core is intended for DC applications. Sintering fuses the iron particles together to form a solid molded article and removes the polymer coating through volatilization. As a result, in addition to the abilities described above, the coating must be capable of being volatilized completely without leaving contaminants and voids within the core. The presence of contaminants or voids within the sintered article reduces the physical strength and properties of the sintered article.

In addition, a significant shortcoming associated with the use of the prior art coatings has been that the coatings will not burn off completely during sintering, thereby leaving a carbonaceous residue within the sintered article. This residue may actually diffuse into the underlying metal particle, causing some degree of deleterious carburization within the sintered article.

As disclosed in U.S. patent application Ser. No. 07/710,427, filed Jun. 7, 1991, assigned to the assignee of the present invention, polyetherimide, polyethersulfone and polyamideimide have been found to perform well as the coating material for powdered iron, so as to form insulated magnetic cores, particularly with respect to the ability to bind the iron particles together and resist thermal and chemical attack, and the ability to serve as a lubricant during the compression molding process. In addition, these polymers adhere well to the underlying metal particle. These polymers are applied to the iron particles using a fluidized bed process which is known in the art.

However, shortcomings associated with the teachings of U.S. Ser. No. 07/710,427 are two-fold. First, the above-described polymers may not compression mold suitably for certain applications due to insufficient lubricity. As a consequence, the magnetic cores may have unsuitably low densities which corresponds to lower magnetic permeability. In addition, the magnet cores tend to stick in the mold cavity, which further results in excessive tool wear and damaged parts. The current solutions to these shortcomings include blending lubricants with the powdered iron before molding and using mold release compounds, such as graphite, on the mold cavity prior to the molding cycle. However, the use of lubricants and mold release compounds may further reduce the density of the magnetic core and may introduce contaminants, such as carbon, into the material. During sintering, the presence of contaminants can cause voids or stress risers to be formed within the sintered article, or the contamination may diffuse into the underlying metal particle so as to detrimentally affect the alloys' properties. In addition, the above-described polymers tend not to volatilize completely upon sintering, therefore adding additional contaminants and/or voids to the sintered article.

Thus, it would be desirable to provide a coating for powdered metals which has the ability to improve lubrication during the molding process and to provide adhesion of the metal particles after molding, so as to attain maximum density and strength of the as-molded article. In addition, the coating should be readily and cleanly volatilized upon heating during a sintering process, so as not to leave contaminants or voids within the sintered article. Further, it would also be desirable if such a coating could be readily used for sintering of a variety of materials.

SUMMARY OF THE INVENTION

It is an object of this invention to provide a coating material for metal particles, wherein the coating material is sufficiently volatile so as to substantially prevent the formation of contamination or voids within a molded article at elevated temperatures, such as during sintering.

It is a further object of this invention that such a coating material also serve as a lubricant to facilitate the initial molding processes of the metal particles prior to sintering, so as to enable maximization of the density of the molded article produced thereby.

It is yet another object of this invention that such a coating material be capable of sufficiently adhering the metal particles together after the molding process so as to permit further handling or use of the molded article prior to sintering.

In accordance with a preferred embodiment of this invention, these and other objects and advantages are accomplished as follows.

According to the present invention, there is provided a polymeric material for coating powdered metals, wherein the polymeric material is sufficiently volatile at elevated temperatures to prevent the formation of contaminants or voids within a sintered article which was originally formed from the coated metal particles. The preferred coating material also provides sufficient lubrication and adhesion between adjacent metal particles during a compaction molding process performed prior to sintering.

The above capabilities are particularly advantageous for the manufacture of sintered articles which are initially molded from the coated particles.

The polymeric material found most suitable to provide the above features is polyphenylene oxide. Where an article molded from the coated particles is to be sintered so as to fuse the metal particles together, such as with DC magnetic cores, polyphenylene oxide is readily volatilized at the elevated sintering temperatures, thereby preventing the formation of contaminants or voids within the sintered article which would reduce the physical properties of the sintered article. In addition, polyphenylene oxide is sufficiently lubricous during the initial molding step that additional lubricants or mold release compounds may be eliminated, therefore preventing the formation of additional contaminants or voids in the subsequently sintered article.

Polyphenylene oxide can achieve the above advantages while being present in relatively low quantities, i.e., less than about one weight percent as compared to the mass of the metal particle. The preferred coating process for purposes of the present invention is a Wurster-type spray-coating fluidized bed of the type known to those skilled in the art, though other coating methods may be used. The fluidized bed serves to recirculate the metal particles within a confined volume numerous times, until each particle has acquired a substantially uniform coating of polyphenylene oxide which is sufficient for purposes of the particular application. The coated metal particles may then be introduced into a suitable molding apparatus, such as a compression or injection molding machine, where the coated metal particles are compressed or injected within a heated mold cavity under a suitably high pressure to compact the coated metal particles to produce a dense, strong and solid article. The article is then appropriately sintered.

In addition, the materials and teachings of this invention are readily applicable to a variety of molding processes used prior to sintering, such as compression or injection molding, as well as hot isostatic pressing, cold isostatic pressing, microwave and ultrasonic molding techniques, as well as others.

Other objects and advantages of this invention will be better appreciated from the following detailed description.

DETAILED DESCRIPTION OF THE INVENTION

A polymeric coating material is provided for coating powdered materials and, more particularly, for coating powdered metals which are molded and sintered under pressure, so as to form, for example, magnets for such applications as AC and DC magnetic cores used in the automotive industry. It is to be noted, though, that the teachings of this invention would extend to the formation of a variety of molded and sintered articles.

According to the present invention, the polymeric material is polyphenylene oxide, which is known in the art by its tradename PPO, an engineering thermoplastic available from the General Electric Company.

Polyphenylene oxide is characterized by excellent mechanical properties and dielectric characteristics and is useful at a temperature range of greater than about 190° C., as generally determined by a standardized heat deflection temperature. Polyphenylene oxide is soluble in some aromatic and chlorinated hydrocarbons, thereby permitting its use in the fluidized coating process. All of the above characteristics are advantageous in view of the coating, molding and sintering processes utilized by the present invention. Furthermore, polyphenylene oxide is insoluble in alcohols, ketones, aliphatic hydrocarbons and water, and is highly resistant to hydrolysis, acids, bases and detergents, thereby making polyphenylene oxide substantially impervious to chemical attack.

According to the present invention, when properly applied to metal particles which are compacted to form a molded article, such as a magnetic core, polyphenylene oxide provides sufficient adhesion between adjacent metal particles to sustain the desired strength and shape of the magnetic core after molding. Furthermore, it has been determined that the polyphenylene oxide present within the molded article can be cleanly volatilized, thereby alleviating the formation of contaminants or voids within the article. Such a capability is advantageous where it is desirable to sinter the molded article, such as in the case of magnetic cores used in DC motors, so as to fuse the metal particles directly together and thereby improve the physical properties of the sintered magnetic core. Specifically, contaminants and voids within a sintered article would significantly reduce the strength and performance of the sintered article. Because the polyphenylene oxide readily volatilizes at the sintering temperatures, magnetic cores which are compression molded from polyphenylene oxide-coated metal particles and then sintered to fuse the metal particles together, produce a physically strong and clean article having high density.

Moreover, polyphenylene oxide provides improved lubrication between metal particles during the molding process prior to sintering. This not only maximizes metal particle density, but also, when used in accordance with this invention, polyphenylene oxide can eliminate or reduce the requirement for additional lubricants. This capability is contrary to the prior art, which must often resort to lubricant additives to enable the metal particles to readily flow into the mold cavity and compact during the molding process.

Polyphenylene oxide is able to achieve the above advantages while being present in low quantities, such as below about one weight percent and most preferably in the range of about 0.40 to about 0.75 weight percent. Though it is foreseeable that greater quantities of polyphenylene oxide could be used, a corresponding reduction in physical properties and/or magnetic properties would result in cases where the molded article is used in the as-formed condition.

The balance of the molded article, about 99 weight percent, consists of metal particles sized preferably in the range of about 5 to about 400 microns, and more preferably in the range of about 125 to about 350 microns, to attain magnetic cores of high permeability greater than about 500 gaussOrsteds at 300 Hz.

The preferred method of coating the metal particles utilizes a Wurster-type spray-coating fluidized bed of the type known to those skilled in the art, although other methods which produce a uniform coating on the particles could also be used. The fluidized bed essentially includes a concentric pair of upright cylindrical vessels, one within the other. The outer vessel has its lower axial end closed to form a floor for the outer vessel only, with the inner vessel being suspended above this floor. The floor has perforations of various sizes through which heated air is drawn through both vessels. The perforations are sized such that the majority of the air flow will occur up through the inner vessel and then down between the inner vessel and the outer vessel.

Prior to introduction into the fluidized bed, it is preferred, but not necessary, that the metal particles be presorted according to size to promote substantially uniform coating thicknesses on the metal particles during the coating process. The metal particles are first sorted into batches of approximately same-sized particles (e.g., small, medium and large). Each batch is then separately processed and later remixed into any desired particle size distribution. If the above steps are not taken, there is a tendency for the larger and smaller particles to be preferentially coated, leaving the mid-sized particles with a significantly thinner coating.

At start-up, a batch of the powdered metal is deposited on the floor and the powder to by coated is circulated at a rate sufficient to coat the particles. According to the batch size and particles sizes, the flow rate of the air will generally be in the range of about 100 to about 200 cubic meters per hour. Also, the air temperature will generally range between about 55° C. and 70° C. when the coating process begins, but will vary during the coating process with the introduction of the metal particles and as the solvent evaporates. If the air temperature is too low, the solvent will not evaporate upon contact with the metal particle, thereby resulting in a poorly coated particle, while if the air temperature is too high, the solvent evaporates too quickly, thereby also preventing the formation of a uniformly thick coating on the particles. As the coating process progresses, each of the particles is randomly coated an extraordinarily large number of times, so as to ensure a uniformly thick coating on the particle.

A spray nozzle located on the floor under the inner chamber serves to introduce the polyphenylene oxide, which is dissolved in an appropriate solvent into the chamber. According to the processing method of this invention, the preferred solvent is chloroform ($CHCl_3$), though other suitable solvents could be used, such as methylene chloride ($CH_2Cl_2$), monochlorobenzene ($C_6H_5Cl$), and trichloroethylene ($CHCl{:}CCl_2$). The solution is preferably about 5 to about 15 weight percent polyphenylene oxide, and more preferably about 10 weight percent polyphenylene oxide, so as to maximize the efficiency of the coating procedure, though suitable coating results can be obtained with an extremely large range of polyphenylene oxide solutions.

The solution is then sprayed into the fluidized bed at a rate of about 80 grams per minute for a 12 inch diameter fluidized bed, with a rate of about 50 to about 100 grams per minute being the preferred range. The preferred spray pressure is about 4.5 bar, with about 4 to about 5 bar being the preferred range. It is to be noted that the deposition parameters may vary considerably, depending on the solvent and deposition camber used. In addition, as stated previously, other deposition methods may also be employed so long as a substantially uniform coating is obtained.

Once coated, the encapsulated metal particles are recirculated by the action of the heated air between the confined volumes defined by the inner and outer vessels. Circulation is continued until each metal particle has acquired a uniform coat of polyphenylene oxide which is sufficient to produce the desired thickness of polyphenylene oxide, preferably between about 0.1 weight percent and about one weight percent, and more preferably between about 0.40 and about 0.75 weight percent, as noted above. Typically, the coating thickness will be in the range of about 0.3 to about 4.5 microns for metal particles in the preferred range of about 5 to about 400 microns.

Thereafter, the coated metal particles may be introduced into a suitable molding apparatus, such as a compression molding or injection molding machine.

Typical molding processes used to form, for example, magnetic cores include compression and injection molding and are generally performed at mold temperatures ranging from about 430° F. and 475° F. with the particles being preheated to about 180° F. and 250° F. At these temperatures, polyphenylene oxide is sufficiently fluid to flow under pressure during the molding operation while also being sufficiently viscous to adhere to the metal particles and provide a lubricating action between adjacent metal particles. As a result, automated handling equipment can be used to process and feed the polyphenylene oxide and coated metal particles throughout the coating and molding processes, resulting in shorter cycle times, and yet the compaction molded article, such as the magnetic core, formed by these processes are characterized by being physically strong and dense, so as to enable immediate handling and use of the as-formed molded article, if desired. Per the standardized ASTM test entitled "3 Point Modulus Test" for powder metals, the strength of the composite metal having less than about one weight percent polyphenylene oxide and iron particles is about 175 to 200 pounds.

In that the metal particles are preheated to a temperature of about 180° F. to about 250° F., and the mold cavity is preheated to a temperature of about 430° F. to about 475° F. for molding, metal particles coated with polyphenylene oxide will readily flow into the mold cavity and, when subjected to typical molding pressures of about 20 to about 50 tons per square inch, will flow sufficiently to become compacted and form a molded article such as a ferromagnetic core whose density is preferably greater than about 7.25 grams per cubic centimeter.

In addition, the lubricous nature of polyphenylene oxide persists after the molding operation to facilitate removal of the molded article from the mold cavity. As a result, reliance upon the use of release compounds to facilitate the removal of the magnetic core is reduced or entirely eliminated, therefore alleviating the potential for contamination and/or voids from lubricants and/or release compounds during sintering. The labor necessary to apply such release compounds is also eliminated, in addition to a significant reduction in tool wear and part breakage which are associated with the molded magnetic core not releasing properly. As a result, the use of polyphenylene oxide as a coating material for metal particles is economically advantageous in that it reduces material and processing costs and downtime.

The coating and molding processes described above can be widely varied to alter the physical and magnetic properties of the molded article, as is known in the art.

Following the above processes, the molded article is then sintered, such as for magnetic cores for DC motor applications or where very high density and strength articles are necessary. However, for purposes of this invention, it is not necessary that an article be formed using the above processes in that an article could be readied for sintering through other methods known in the art. In addition, it is foreseeable that a single sintering step could be used with a loose quantity of particles coated with polyphenylene oxide, eliminating completely the above compaction process.

The applications for which sintering is advantageous encompass the use of many types of sinterable particles, such as copper and its alloys, aluminum and its alloys, stainless steel, nickel and its alloys, lead and its alloys, rare earth-iron-boron alloys and ceramics, or any other material which may be sintered. However, because polyphenylene oxide volatilizes at generally about 800° F. to about 900° F., the material for the particles must be capable of sintering at or above this temperature.

The ability for polyphenylene oxide to be cleanly volatilized is advantageous for use in numerous applications other than the manufacture of magnetic cores. Such applications are entirely within the scope of this invention in that, as an advantageous result of using polyphenylene oxide as the polymeric coating material, the molded articles formed according to the teachings of the present invention will be typified by being very dense and strong, thereby permitting the formation of a variety of configurations, including thin-walled, complex configurations.

As a specific but not limiting example, iron powder particles commercially available from Quebec Metal Powders (1001HP iron powder) were coated, molded and sintered in accordance with the teachings of this invention. The particle sizes of the iron particles may range from about 44 to about 250 microns. However, a very small percentage of the powder may have a particle size as small as 10 microns. The powder is about 99.7% Fe, 0.003% C, 0.0005% N, 0.006% S and 0.004% P. The iron powder particles are then coated with the preferred thermoplastic material, polyphenylene oxide, using the above-described fluidized coating method, to a thickness corresponding to an amount of between about 0.1 and about one weight percent as compared to the total mass of the particles.

After the iron particles have been coated, a quantity of the coated iron particles is fed into a die or mold of a press. The coated iron particles are preheated to about 180° F. and about 250° F., and the die or mold is heated to a temperature of between about 430° F. and 475° F. With the coated particles in the mold or die, it is compressed at a pressure of about 40 to about 50 tsi for a sufficient duration, such as up to about 10 seconds. The thermoplastic polyphenylene oxide material takes on a tacky state during this operation.

During the compression molding, the polyphenylene oxide operates as a lubricant which increases the density of the molded article. The density will exceed about 7.4 grams per cubic centimeter and is substantially uniform throughout the article.

After the article has been compression molded as described, the compressed article is sintered at a temperature of between about 2000° F. and 2100° F., preferably about 2050° F., for about 15 to about 45 minutes. The polyphenylene oxide is burned off during the high temperature sintering operation since its volatilization temperature is generally about 800° F. to about 900° F., leaving virtually no contaminants within the sintered article. The iron powder particles no longer have a coating and fuse together to form a dense, strong sintered article.

From the above, it will be apparent to one skilled in the art that a significant advantage of the present invention is that there is provided a polymeric coating for powdered metals, wherein the polymeric coating material possesses numerous properties which are beneficial to forming a sintered article, such as a magnetic core from a powdered metal. These properties include the ability to serve as a lubricant and an adhesive during the initial molding steps, and being sufficiently volatile at sintering temperatures to prevent the formation of contaminants or voids within the magnetic core formed with the powdered metal.

In particular, where a magnetic core is to be sintered so as to fuse the metal particles, such as for DC magnetic core applications, the polyphenylene oxide is readily volatilized without leaving contaminants or voids within the sintered article which would otherwise reduce the physical strength of the magnetic core.

The polyphenylene oxide coating also provides lubrication between the metal particles to enable higher core densities to be obtained by the molding process and provides adhesion of the metal particles after molding to impart sufficient strength so as to permit normal handling and, where appropriate, to permit immediate use of the molded article. The polyphenylene oxide coating thus can alleviate the requirements for additional lubricants and/or mold release compounds during molding, which correspondingly prevents the formation of additional contaminants within the sintered article from these sources.

In addition, the teachings of this invention could be employed to sinter coated particles together to form a solid article using a variety of metals and their alloys or ceramics. Foreseeably, almost any type of particulate material could be coated and sintered appropriately.

It is also foreseeable that the polyphenylene oxide blend, known by its tradename "Noryl", which is also available from the General Electric Company, could be used successfully as a substitute for polyphenylene oxide. However, Noryl does not exhibit the physical and chemical properties to the level which polyphenylene oxide is capable, and thus would be expected to provide results somewhat inferior to polyphenylene oxide.

Therefore, while our invention has been described in terms of a preferred embodiment, it is apparent that other forms could be adopted by one skilled in the art;

for example, by modifying the processing parameters such as the temperatures or pressures employed, or by substituting appropriate powdered materials, or by utilizing the particular materials and methods for use in an alternative application. Accordingly, the scope of our invention is to be limited only by the following claims.

The embodiments of the invention in which an exclusive property or privilege is claimed are defined as follows:

1. A method for forming a sintered article comprising the steps of:

depositing a substantially uniform encapsulating layer of a fugitive binder on each of a plurality of particles such that said plurality of coated particles comprises less than about one weight percent of said binder, said binder consisting essentially of polyphenylene oxide;

compacting said plurality of particles to form a molded article; and sintering said molded article such that substantially all of said polyphenylene oxide is volatilized from said molded article so as to substantially prevent the formation of contaminants and voids within the sintered article, and such that said plurality of particles are fused together;

said polyphenylene oxide serving to provide lubrication between said plurality of particles during said compacting step without the requirement for extraneous lubricants and to substantially disappear from said molded article during said sintering step.

2. A method as recited in claim 1 wherein each of said plurality of particles is a ferromagnetic material.

3. A method as recited in claim 1 wherein said layer of polyphenylene oxide is deposited to a thickness of about 0.3 to about 4.5 microns on each of said plurality of particles.

4. A method as recited in claim 1 wherein each of said plurality of particles has a size range of about 5 to about 400 microns.

5. A method as recited in claim 1 wherein said layer of polyphenylene oxide is deposited on said plurality of particles using fluidized bed spray methods.

6. A method as recited in claim 1 wherein said step of compacting occurs within a mold cavity at a temperature and pressure which are sufficient to adhere said plurality of particles together with said polyphenylene oxide.

7. A method as recited in claim 1 wherein said plurality of particles comprises about 0.4 to about 0.75 weight percent of said polyphenylene oxide after said depositing step.

8. A method for forming a sintered article comprising the steps of:

depositing a substantially uniform encapsulating layer of a fugitive binder on each of a plurality of particles such that said plurality of coated particles comprises about 0.4 to about 0.75 weight percent of said binder, said binder consisting essentially of polyphenylene oxide, said plurality of particles ranging in size from about 5 to about 400 microns;

compacting said plurality of particles within a mold cavity at a temperature and pressure which are sufficient to compact and adhere said plurality of particles together with said polyphenylene oxide to form a molded article; and sintering said molded article at a temperature such that substantially all of said polyphenylene oxide is volatilized from said molded article so as to substantially prevent the formation of contaminants and voids within the sintered article, and such that said plurality of particles are fused together;

said polyphenylene oxide serving to provide lubrication between said plurality of particles during said compacting step without the requirement for extraneous lubricants and to substantially disappear from said molded article during said sintering step.

9. A method as recited in claim 8 wherein each of said plurality of particles is a ferromagnetic material.

10. A method as recited in claim 8 wherein said molded article is sintered at a temperature of at least about 2000° F.

11. A method as recited in claim 8 wherein said layer of polyphenylene oxide is deposited on said plurality of particles using fluidized bed spray methods.

12. A method as recited in claim 8 wherein said mold cavity is heated to a temperature of about 430° F. to about 475° F., and wherein said pressure for compacting said plurality of particles is about 20 to about 50 tons per square inch.

13. A sintered article formed according to the steps of:

depositing a substantially uniform encapsulating layer of polyphenylene oxide on each of a plurality of ferromagnetic particles such that said plurality of coated particles comprises about 0.1 to about 1 weight percent of said polyphenylene oxide, said plurality of particles ranging in size from about 5 to about 400 microns;

compacting said plurality of particles within a mold cavity at a temperature and pressure which are sufficient to compact and adhere said plurality of particles together with said polyphenylene oxide to form a molded article; and sintering said molded article at a temperature such that substantially all of said polyphenylene oxide is volatilized from said molded article so as to substantially prevent the formation of contaminants and voids within the sintered article, and such that said plurality of ferromagnetic particles are fused together to form the sintered article, said sintered article being characterized by essentially comprising only said fused plurality of ferromagnetic particles;

said polyphenylene oxide serving to provide lubrication between said plurality of particles during said compacting step without the requirement for extraneous lubricants and to substantially disappear from said molded article during said sintering step.

14. A sintered article as recited in claim 13 wherein said molded article is sintered at a temperature of at least about 2000° F.

15. A sintered article as recited in claim 13 wherein said mold cavity is heated to a temperature of about 430° F. to about 475° F., and wherein said pressure for compacting said plurality of particles is about 20 to about 50 tons per square inch.

* * * * *